US005890829A

United States Patent [19]

Hesse

[11] Patent Number: 5,890,829

[45] Date of Patent: Apr. 6, 1999

[54] RESERVOIR HANDLE SCRUB BRUSH

[76] Inventor: Mark K. Hesse, 9454 Highway 12, West, Bentonville, Ark. 72712

[21] Appl. No.: 990,695

[22] Filed: Dec. 15, 1997

[51] Int. Cl.[6] ..... A46B 11/02

[52] U.S. Cl. ..... 401/179; 222/391; 401/181; 401/271

[58] Field of Search ..... 401/179, 181, 401/182, 271; 222/391

[56] References Cited

U.S. PATENT DOCUMENTS

| | | | |
|---|---|---|---|
| 2,438,843 | 3/1948 | Correa | 401/181 X |
| 4,072,254 | 2/1978 | Cox | 222/391 |
| 5,116,151 | 5/1992 | Lytton et al. | 401/179 X |
| 5,141,348 | 8/1992 | Tartt | 401/181 X |

FOREIGN PATENT DOCUMENTS

| | | | |
|---|---|---|---|
| 449371 | 1/1949 | Italy | 401/271 |
| 82697 | 2/1935 | Sweden | 401/179 |

*Primary Examiner*—Steven A. Bratile
*Attorney, Agent, or Firm*—Robert K. Rhea

[57] ABSTRACT

A cleaning fluid reservoir handle scrub brush is formed by a bristle brush attached to one end of an elongated tube having a piston adjacent one end portion forming a reservoir of fluid. The piston includes a piston rod which is gripped by a manually operated trigger mechanism to move the piston toward the bristle brush and force cleaning fluid through check valve closed apertures into the bristles of the brush.

1 Claim, 3 Drawing Sheets

RESERVOIR HANDLE SCRUB BRUSH

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to utility brushes and more particularly to a brush which includes an elongated reservoir handle.

1. Field of the Invention

Cleaning various objects such as automobiles, building siding or windows and other structures usually involve the use of a brush to dislodge dirt or stains on the surface being cleaned and a cleaning fluid such as soap or soapy water. The hand held brush and a bucket of soapy water, as the cleaning fluid, is an inefficient and time consuming operation since the brush bristles hold very little of the cleaning fluid when applied to the surface to be cleaned after being dipped in the soapy water.

It is therefore desirable to provide a brush preferably having an elongated handle containing a quantity of the cleaning fluid which facilitates cleaning the article by a scrubbing action and applying the cleaning fluid to the brush head by a trigger device operated by the user. This invention provides such a cleaning tool.

2. Description of the Prior Art

U.S. Pat. No. 4,507,004, issued Mar. 26, 1985 to Moffitt, Jr. for Side Handle Reservoir Brush. This patent discloses a utility brush for cleaning automobiles or windows.

U.S. Pat. No. 5,364,198, issued Nov. 15, 1994 to Skenderi for Self Contained Window Cleaning Implement. This patent discloses an elongated tubular member having a container at one end portion and a squeegee attached to its other end. This patent features a pump action dispensing system by a manually operated trigger adjacent the reservoir bottle which ejects fluid through a tube and nozzle at the forward end of the instrument adjacent the squeegee which may be utilized for removing fluid from a window or windshield.

This invention is believed distinctive over the above named patents by providing a manually operated trigger mechanism for incrementally moving a piston against cleaning fluid contained in a tubular reservoir connected with a brush head for forcing the cleaning fluid into the brush head during the scrubbing action.

U.S. Pat. No. 3,118,166, issued Jan. 21, 1964 to Bell for Window Cleaning Device and U.S. Pat. No. 4,372,700, issued Feb. 8, 1983 to Moffitt, Jr. for Suction Pump Reservoir Brush are believed good examples of the further state-of-the-art. Both of these patents disclose a manually operated piston which draws cleaning fluid into a tube for exhausting the cleaning fluid into a brush head.

BRIEF SUMMARY OF THE INVENTION

A bristle brush head is connected to one end of an elongated tubular reservoir handle. The handle contains a piston axially supported in the handle by a rod extending through a trigger assembly connected with the handle intermediate its ends for moving the piston toward the brush head and ejecting cleaning fluid into the brush head by a manually operated trigger assembly moving the piston toward the brush head.

The principal object of this invention is to provide a cleaning fluid brush applicator having an elongated reservoir handle containing a quantity of cleaning fluid ejected from the brush head by a manually operated trigger mechanism gripping a piston rod and moving the piston toward the brush head.

DETAILED DESCRIPTION OF THE INVENTION

Figure 1:
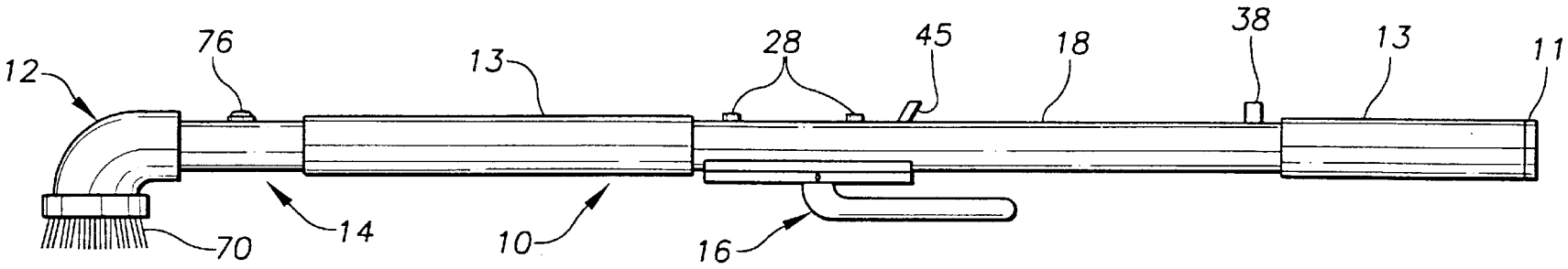
FIG. 1 is a side elevational view.
Figure 2:
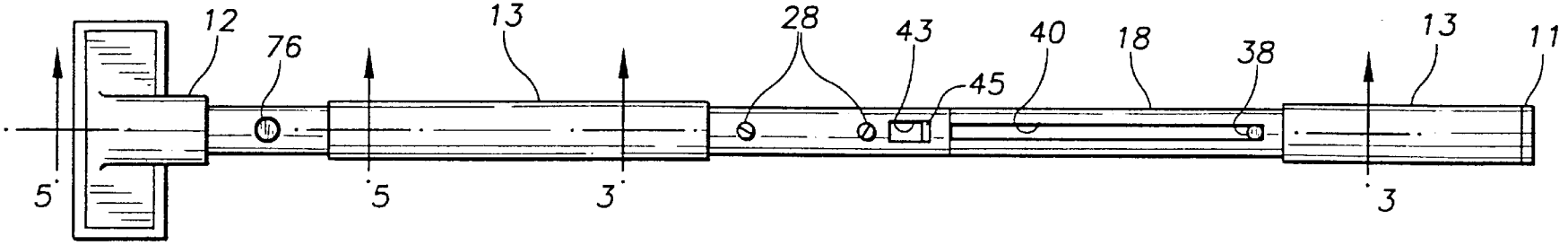
FIG. 2 is a top view of FIG. 1.

Like characters of reference designate like parts in those figures of the drawings in which they occur.

In the drawings:

The reference numeral 10 indicates the device as a whole which is elongated cylindrical in general configuration. The device 10 comprises a brush head 12 axially connected to one end of a handle means 14 having a trigger means 16 intermediate its ends. The handle means 14 comprises an elongated tube 18 of selected size, for example, 0.914M (3') long and 30 mm (1.25") diameter, having the brush head 12 connected with its forward end and having a cap 11 closing its rearward end and rubber hand grips 13 on its forward and rearward end portions.

Figure 3:
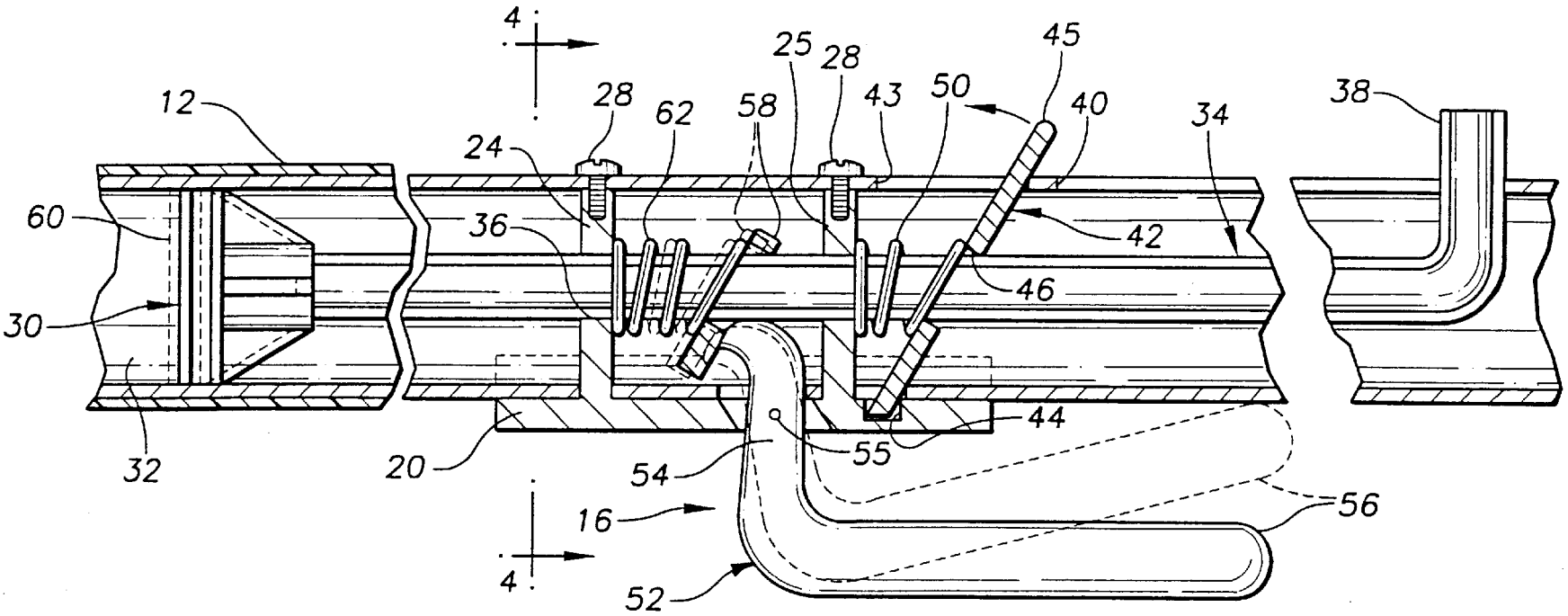
FIG. 3 is a fragmentary vertical cross sectional view to an enlarged scale taken substantially along the line 3—3 of FIG. 2.
Figure 4:
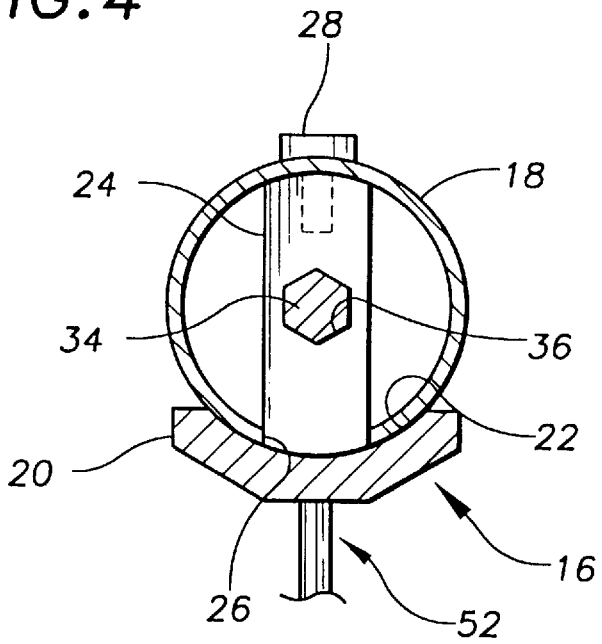
FIG. 4 is a vertical cross sectional view taken substantially along the line 4—4 of FIG. 3; and, FIG. 5 is a fragmentary vertical cross sectional view, to another scale, taken substantially along the line 5—5 of FIG. 2.
Figure 5:
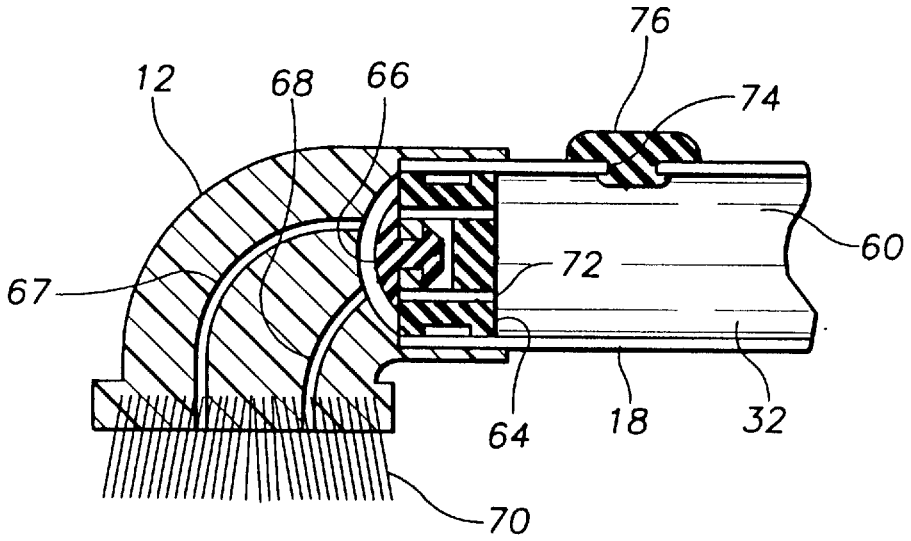

The trigger means 16 comprises a longitudinally extending base member 20 having a width less than the diameter of the tube 18 and a length 7.62 cm (3") and further having an transversely arcuate surface 22 contiguously contacting the depending surface of the tube 18, intermediate its ends, as viewed in FIGS. 1, 3 and 4. The base member 20 is further provided with a pair of upstanding forward to rearwardly spaced posts 24 and 25 projecting through suitable tube apertures 26 and terminating in cooperative contacting relation, at their upper ends, with the inner pheriphy of the tube 18 for receiving a pair of screws 28 securing the trigger means 16 to the tube.

A piston 30, slidably sealing with the inner periphery of the tube 18, is disposed in the forward end portion of the tube 18 forwardly of the trigger means post 24 to form a fluid reservoir 32 between the piston and the brush head 12. An elongated piston rod 34 is axially connected at its forward end with the piston 30 and slidably projects axially rearward through suitable apertures 36 formed in the trigger means posts 24 and 25. The piston rod 34 is turned upwardly at its rearward end portion through a longitudinal slot 40 formed in the top surface of the tube 18 to form a piston rod handle 38 longitudinally slidable forwardly and rearwardly for the purposes presently explained.

Rearward movement of the piston and its rod 34 is normally prevented by a strap-like piston rod stop 42 pivotally supported at its depending end portion in a recess 44, formed in the trigger means base member 20, and canted rearwardly to project at its upper handle end portion 45 through a slot 43 longitudinally formed in the top surface in the tube 18 forwardly of the piston rod handle slot 40. The piston rod stop 42 is provided with an aperture 46 loosely surrounding a portion of the piston rod 34 and fictionally gripping diametrically opposing surfaces of the piston rod when biased rearwardly at its upper end portion by a spring 50 surrounding the piston rod, and, interposed between the piston rod stop 42 and rearward post 25 for normally precluding rearward movement of the piston.

The trigger means 16 further includes a manually operated generally L-shaped lever 52 having its foot portion 54 projecting into the tube 18 and pivotally supported by a pin 55 in the trigger means base member 20. The lever leg or handle portion 56 is moveable toward and away from the adjacent surface of the tube 18 for pivoting the foot portion 54 toward and forcing a rearwardly canted piston rod gripping disk 58, similarly surrounding a portion of the piston rod 34, in a forward direction for ejecting cleaning fluid 60 from the reservoir 32 to the brush head 12. The lever leg or handle portion 56 is biased downwardly as viewed in the drawings, and the disk 58 rearwardly on the rod 34, upon release of the handle 56 by a spring 62 surrounding the piston rod 34 and interposed between the forward post 24 and the piston rod gripping disk 58 for subsequent movement of the handle 56 toward the tube 18 in a rachet-like action.

A resilient plug 64 closes the forward end of the tube 18 and a resilient check valve 66 is axially secured to the downstream end surface of the plug 64 and communicates with openings 67 and 68 in the brush head 12 for providing fluid communication with the bristles 70. The peripheral edge of the resilient check valve 66 overlies the downstream end of one or more orifices 72 extending axially through the plug 64. Adjacent the brush head 12 the wall of the tube 18 is provided with a fill opening 74 for filling the reservoir 32 with the cleaning fluid 60. A resilient plug 76 closes the fill opening 74.

OPERATION

The piston rod stop 42 is manually moved forwardly to release its grip on the piston rod 34 and the piston rod is manually moved by its handle 38 toward the rearward limit of the slot 40 disposing the piston 30 adjacent the forward post 24. The reservoir 32 is filled through the fill opening 74. With the fill plug 76 in place the piston rod is manually moved by its handle 38 to dispose the piston adjacent the fluid 60 within the reservoir 32. In use, the device 10 is grasped by one of its grips 13 with one hand while the user applies the cleaning fluid 60 to the brush bristles 70 by pivoting the handle 56 toward the tube 18 which incrementally moves the piston and its rod in a forward direction placing the fluid 60 under sufficient pressure to exit through the orifices 72 and the check valve 66 into the bristles 70.

Obviously the invention is susceptible to changes or alterations without defeating its practicability. Therefore, I do not wish to be confined to the preferred embodiment shown in the drawings and described herein.

What is claimed is:

1. A cleaning brush having a brush head and having bristles on one side thereof, an elongated tubular hollow handle having forward and rearward ends forming an elongated cleaning fluid reservoir connected at a forward end with another side of said brush head, a passageway through said brush head communicating said reservoir with the brush bristles, and a piston facing the brush head within the reservoir and having a piston rod projecting toward the other end portion of said hollow handle, the improvement comprising:

trigger means comprising: a longitudinally extending base having a width less than the diameter of the tubular handle and having a transverse arcuate surface cooperatively contacting the outer surface of said hollow handle intermediate its ends for supporting a pair of longitudinally spaced posts transversely projecting into said hollow handle and having aligned apertures slidably supporting said piston rod;

friction means including a canted member between said posts surrounding and gripping opposite surfaces of said piston rod adjacent the inward end of, a lever;

a first resilient means interposed between the forward post and said canted member for biasing the latter rearwardly;

lever means including an L-shaped lever pivotally connected with said base and having a foot portion projecting into said hollow handle rearwardly of and in contact with said canted member for forward and rearward vertical pivoting movement of the lever about its pivotal axis and moving said piston toward the brush head in response to vertical pivoting movement of the other end portion of said lever toward and away from said handle;

said hollow handle having a rearward longitudinal slot opposite and rearwardly of said base for longitudinally slidably receiving an upturned handle end portion of said piston rod;

said hollow handle having a forward slot adjacent the rear ward longitudinal slot receiving the upper handle end portion of a strap-like rearwardly canted piston rod stop means pivotally supported at its other end portion by said base and surrounding and gripping opposite surfaces of said piston rod rearwardly of the rearward post for normally precluding rearward movement of said piston; and, a second resilient means interposed between the rearward post and said piston rod stop means for normally biasing the piston rod stop means handle end portion rearwardly.

* * * * *